US005908511A

United States Patent [19]

Bianchi

[11] Patent Number: 5,908,511

[45] **Date of Patent: *Jun. 1, 1999**

[54] PROCESS FOR STAINLESS STEEL PICKLING AND PASSIVATION WITHOUT USING NITRIC ACID

[75] Inventor: Marco Bianchi, Milan, Italy

[73] Assignee: ITB S.r.l., Milan, Italy

[ * ] Notice: This patent is subject to a terminal disclaimer.

[21] Appl. No.: 08/874,797

[22] Filed: Jun. 13, 1997

Related U.S. Application Data

[63] Continuation of application No. 08/579,878, Dec. 28, 1995, abandoned, which is a continuation of application No. 08/319,952, Oct. 7, 1994, abandoned, which is a continuation of application No. 08/097,105, Jul. 26, 1993, abandoned.

[30] Foreign Application Priority Data

Aug. 6, 1992 [IT] Italy ..... MI92A1946

[51] Int. Cl.[6] ..... C23G 1/02

[52] U.S. Cl. ..... 134/3; 134/2; 134/41; 252/79.2; 252/79.3

[58] Field of Search ..... 134/2, 3, 41; 252/79.2, 252/79.3

[56] References Cited

U.S. PATENT DOCUMENTS

| | | | |
|---|---|---|---|
| 5,108,544 | 4/1992 | Hakansson | 156/664 |
| 5,154,774 | 10/1992 | Bousquet et al. | 134/3 |
| 5,354,383 | 10/1994 | Bianchi | 134/3 |
| 5,688,755 | 11/1997 | Ikeda et al. | 510/254 |
| 5,690,748 | 11/1997 | Henriet | 134/3 |

FOREIGN PATENT DOCUMENTS

| | | |
|---|---|---|
| 2551465 | 9/1983 | France . |
| 57-198273 | 5/1981 | Japan . |
| 57-35686 | 2/1982 | Japan . |
| 61-235581 | 10/1986 | Japan . |
| 2000196 | 1/1979 | United Kingdom . |
| WO9105079 | 4/1991 | WIPO . |

*Primary Examiner*—Zeinab El-Arini
*Attorney, Agent, or Firm*—Hedman, Gibson & Costigan, P.C.

[57] ABSTRACT

Process for stainless steel pickling consisting in placing the material to be treated in a bath kept at a temperature ranging from 30° C. to 70° C. having the following initial composition:

a) $H_2SO_4$ 150 g/l at least b) $Fe^{3+}$ 15 g/l " "

c) HF 40 g/l " "

d) $H_2O_2$ (added with known stabilizers) 1–20 g/l e) emulsifiers, wetting agents, polishing agents, acid attack inhibitors;

in the bath being fed continuously:

an air flow equal at least to 3 $m^3$/h per $m^3$ bath min. and a stabilized $H_2O_2$ quantity adjusted to the bath redox potential to be kept at ≧250 mV.

12 Claims, 3 Drawing Sheets

PROCESS FOR STAINLESS STEEL PICKLING AND PASSIVATION WITHOUT USING NITRIC ACID

This is a continuation of Ser. No. 579,878 filed Dec. 28, 1995, abandoned, which is a continuation of application Ser. No. 08/319,952, filed Oct. 7, 1994 now abandoned; which is a continuation of application Ser. No. 08/097,105, filed Jul. 26, 1993, now abandoned.

TECHNICAL FIELD

As is known when, during the manufacturing process, iron and steel industry products undergo hot-rolling or intermediates undergo heat treatment, such as for instance annealing, the material is coated with a thinner or thicker oxidation layer. In consideration of the final products having to exhibit a polished and glossy finish, the oxidation layer is to be removed entirely. This is done through the well-known pickling process generally using mineral inorganic acids, such as hydrochloric acid, sulphuric acid, nitric acid, and hydrofluoric acid, either individually or as mixtures. According to the industrial processes currently applied, stainless steel pickling is normally almost exclusively based on the use of a nitric-hydrofluoric acid mixture, the respective acid concentrations depending on the type of plant, on the type of steel to be pickled, on the steel surface properties and on the shape of the manufactured article to be treated. Although the process is undoubtedly economic and leads to excellent results, it involves extremely serious ecological problems hard to solve, brought about by the use of nitric acid. Actually, while on the one hand highly polluting nitrogen oxide vapours having general formula $NO_x$, aggressive toward metallic and non-metallic materials with which they come into contact, are vented to the atmosphere, on the other hand high nitrate concentrations are reached in wash water and spent baths, both types of pollutants requiring treatment prior to disposal. The removal of $NO_x$ from air and of nitrates from baths involves huge plant operation problems and high operating costs, with no certainty about the obtainment of targets complying with the regulations in force. This means that the resulting industrial plant investment costs can be hardly borne in most cases.

A pickling method not requiring the use of nitric acid is therefore demanded by industry and various proposals in this sense have been made worldwide mainly in these last ten years.

Methods alternative to those using nitric acid: state of the art

A critical examination both of patents covering methods alternative to the traditional stainless steel pickling process based on the use of $HNO_3$+HF, no longer containing nitric acid, and of the main relating technical literature has demonstrated the following:

A) Japanese patent JP 50071524 published on Jun. 13, 1975 (see Derwent Abstract No. 76-78076X/42) provides for the use of hydrochloric acid and ferric chloride at 70° C., for a treatment time of 20".

B) Japanese patents JP 55018552 published on Feb. 8, 1980 (see Derwent Abstract No. 80-21157C/12) and JP 55050468 published on Apr. 12, 1980 (see Derwent Abstract No. 80-37402C/21) provide for three steps:
   (1) initial descaling in sulphuric or hydrochloric acid,
   (2) immersion, in the former case, in a potassium permanganate and inorganic acids (non HF) solution, in the latter case, in a ferric nitrate, ferric sulphate and peroxydisulphuric acid solution,
   (3) pressure water jet or ultrasonic final washing.

C) Swedish patent SE 8001911 published on Oct. 12, 1981 (see Derwent Abstract No. 81-94307D/51) relates to a treatment in a sulphuric acid and hydrogen peroxide solution; treatment time range: from 1 to 120 minutes (preferred range: 1–20'); temperature range: from 10° C. to 90° C. (preferred range: 30–60° C.).

D) German patent DD 244362 (see Derwent Abstract No. 87-228825/33) published on Apr. 1, 1987 provides for the use, at 15–30° C., of a solution formed by chromic acid, sulphuric acid, hydrofluoric acid and an inhibitor (hexamethylenetetramine); the bath is later neutralized with calcium and barium salts.

E) German patent DE 3937438 published on Aug. 30, 1990 (see Derwent Abstract No. 90-268965/36) mainly applies to the wire treatment industry and provides for the use of a hydrofluoric acid solution containing $Fe^{3+}$ fed as additive in the form of complex fluoride. Then, the solution is fed with a gas and/or an oxygenated fluid means, subjected to electrolysis to obtain nascent oxygen capable of oxidizing iron from bivalent to trivalent.

F) German patent DE 3222532 published on Dec. 22, 1983 (see Derwent Abstract No. 84-000662/01) relates to the pickling of austenitic steel pipes or vessels, the inner surfaces whereof are treated at 15–30° C. with a solution consisting of hydrofluoric acid and peroxides (hydrogen peroxide, or stabilized sodium perborate, or organic peroxides in general), while the outer surfaces are pickled with pastes consisting of hydrofluoric acid, peroxides and filler (carboxymethylcellulose); pastes must be removed by neutralization with calcium salts, while peroxides are destroyed either by catalysis or by heating.

G) TOKAI Denka Kogyo's English patent 2,000,196 provides for the use of a pickling bath consisting of ferric sulphate and hydrofluoric acid. Sulphuric acid and hydrogen peroxide are added continuously in a 1:1 molar ratio, for the purpose of keeping an adequate ferric ion concentration. The patent claims the pickling treatment control method by continuous checking of the redox potential to be kept at ≧300 mV by controlled $H_2SO_4$+$H_2O_2$ feeding.

H) Two much alike patents, U.S. Pat. No. 5,154,774 and EP 236354 (WO 87/01739), provide for the use of a pickling solution consisting of hydrofluoric acid (5–50 g/l) and trivalent ferric ion added as fluorinated complexes, continuously blown into with air and oxygen; treatment time range: 30" to 5'; temperature range: 10° C. to 70° C.; continuous checking is recommended for redox potential, which should be kept at −200 to +800 mV, in the case of the former patent, and at +100 to +300 mV, in the case of the latter patent; if the potential requires to be raised, an oxidizer such as potassium permanganate or hydrogen peroxide should be added. All pickling tests were conducted on sheets only.

Finally, there are two further patents regarding the possibility of avoiding or minimizing the formation of nitrogen oxides $NO_x$ in baths using nitric acid, by the direct addition of suitable oxidizers to the pickling bath: the former, Japanese patent JP 58110682 dated Jul. 1, 1983 (see Derwent Abstract No. 83-731743/32), provides for the use of hydrogen peroxide; the latter, Swedish patent SE 8305648 dated Apr. 15, 1985—priority date Oct. 14, 1983, (see Derwent Abstract No. 85-176174/29)—provides for the use of hydrogen peroxide and/or, as an alternative, of urea.

Nevertheless, despite this proliferation of patents, the traditional process based on the use of nitric and hydrofluoric acid is still massively applied all over the world and none of the alternatives proposed thus far and outlined above is being applied in industry.

DESCRIPTION OF THE INVENTION

The process which is the subject of the present patent application can be affirmed—after the brilliant results of months of treatment in commercial-scale plants—to constitute an unobjectionably surpassing of any of the aforementioned methods. When compared with such methods, the invention deepens some of their interesting principles, which are harmonized and rationalized according to an exhaustive scheme, integrated with a great number of elements of an absolutely innovative character.

The process is based on the use of a pickling bath containing iron ions, $H_2SO_4$, HF, $H_2O_2$ and conventional additives—such as wetting agents, emulsifiers, polishing agents, inhibitors—continuously blown into with a strong air flow. The operating temperature normally ranges from 30° C. to 70° C., its value depending to a large extent on the type of steel and on the type of plant, in which connection it is of basic importance that the possibility of performing mechanical descaling upstream of chemical pickling be secured. The basic process features are described hereinafter.

Content of inorganic mineral acids in the bath: a solution containing the following is prepared for the pickling bath: at least 150 g/l $H_2SO_4$, preferably 170 g/l, and at least 40 g/l HF, preferably 50 g/l. Several are the functions of both acids: among the most important, those of maintaining process pH below 1.5, preferably from 0 to 1, and of removing the oxides due to heat treatment from the steel surface. Hydrofluoric acid is meant to complex $Fe^{3+}$ and $Cr^{3+}$ ions as much as possible and depassivate the oxidized material, bringing the electrode potential to an active and/or active/passive dissolution area (see hereinafter). In the absence of hydrofluoric acid, the operating potential rises to the material steady passivity field and descaling practically does not take place. Besides contributing to the total and free acidity of the solution, sulphuric acid exerts a passivating effect similar to the one exerted by nitric acid.

Since, in the course of pickling, the contents of the two acids—mainly of hydrofluoric acid—tend to reduce, periodical feeding of same has to be performed as a function of the results of bath analysis (determination of free acidity and fluoride ions), as illustrated in the examples hereinafter.

$Fe^{3+}$ ion content in the bath: still at the time of bath preparation, the pickling solution contains an amount of $Fe^{3+}$ ions not below 15 g/l, added as ferric sulphate: the function of such ions is of replacing—as oxidizer—nitric acid, according to the reaction $2Fe^{3+}+Fe—3Fe^{2+}$, favoured by the bath pH conditions. During the process cycle, proper conditions must continuously be secured to allow at least 55% of the total iron dissolved in the bath to be present as $Fe^{3+}$. The oxidation of $Fe^{2+}$ to $Fe^{3+}$ ions during the process to keep the latter concentration above the minimun preset value is secured by a combined mechanical-chemical action due to the air blown into the bath as well as to $H_2O_2$ added continuously to the bath in small quantities.

Continuous addition of stabilized hydrogen peroxide: needless to say that to secure process economics it is necessary to use as little hydrogen peroxide as possible. This is why it is very important to use hydrogen peroxide containing a known stabilizer capable of preventing, or at least of reducing significantly, the peroxide decomposition process under the following conditions: temperature up to 70° C., strongly acid bath pH, iron content even exceeding 100 g/l, presence of ions of transition metals such as Ni and Cr—known to be destabilizers. Stabilizers for $H_2O_2$ effective in acid medium are for instance: 8-hydroxy-quinoline, sodium stannate, phosphoric acids, salycylic acid, pyridincarboxylic acid. As a particularly suitable stabilizer came out phenacetin (i.e. acetyl-p-phenetidine) used in amount corresponding to 5+20 ppm to the pickling bath.

As this stabilizator undergo a slow decomposition in the pickling bath, a continous or periodical addition of stabilizer to the bath is necessary.

The use of duly stabilized $H_2O_2$, combined with the use of air blown into the bath, has made it possible to develop a process based on the use of $H_2O_2$, which has resulted to be economic, an advantage that no known process has ever been capable of offering. The pickling bath is prepared with an initial $H_2O_2$ quantity (as 130 vol. commercial product) ranging from 1 to 20 g/l, preferably from 2 to 5 g/l.

During pickling, continuous $H_2O_2$ feeding is adjusted to the type of steel to be pickled, to the surface properties of the manufacture (or semimanufactured product), as well as to the quantity and quality of hot-rolling or annealing scales. The addition of $H_2O_2$ during the process cyle is substantially adjusted to the pre-set bath oxidation potential, which is kept at the pre-set value by the combined action of $H_2O_2$ and air blown into.

Continuous air blowing: during pickling, a continuous air flow is kept in the bath, in the order of at least 3 $m^3/m^3$ bath per pickling hour. The air flow, admitted at a proper rate, favours bath agitation, a major condition for good pickling. Actually, agitation continuously perturbs the liminal layer of the bath, near the surface to be treated, which is thus continuously kept in direct contact with fresh pickling solution. Air blowing into from the vessel bottom, through drilled pipes or proper blowing items, secures excellent mechanical agitation and pickling liquid homogenization.

Redox potential control: as is known, stainless steel behaviour in acid mixtures is characterized by polarization curves, which exhibit activity, passivity and transpassivity phases depending on the potential value.

BRIEF DESCRIPTION OF THE DRAWINGS

Legend of FIG. 1

Typical polarization curve of stainless steel in deaerated acid solution $EO_2EH_2$ equilibrium potentials of O and H developping reactions $E_p$ critical passivation potential $E_{pc}$ complete passivation potential $E_o$ free corrosion or null (external) current potential $E_M$ equilibrium potential of alloy anodic dissolution reaction $E_T$ transpassivation potential a) anodic dissolution with $H_2$ development b) anodic dissolution without $H_2$ development

Figure 2:
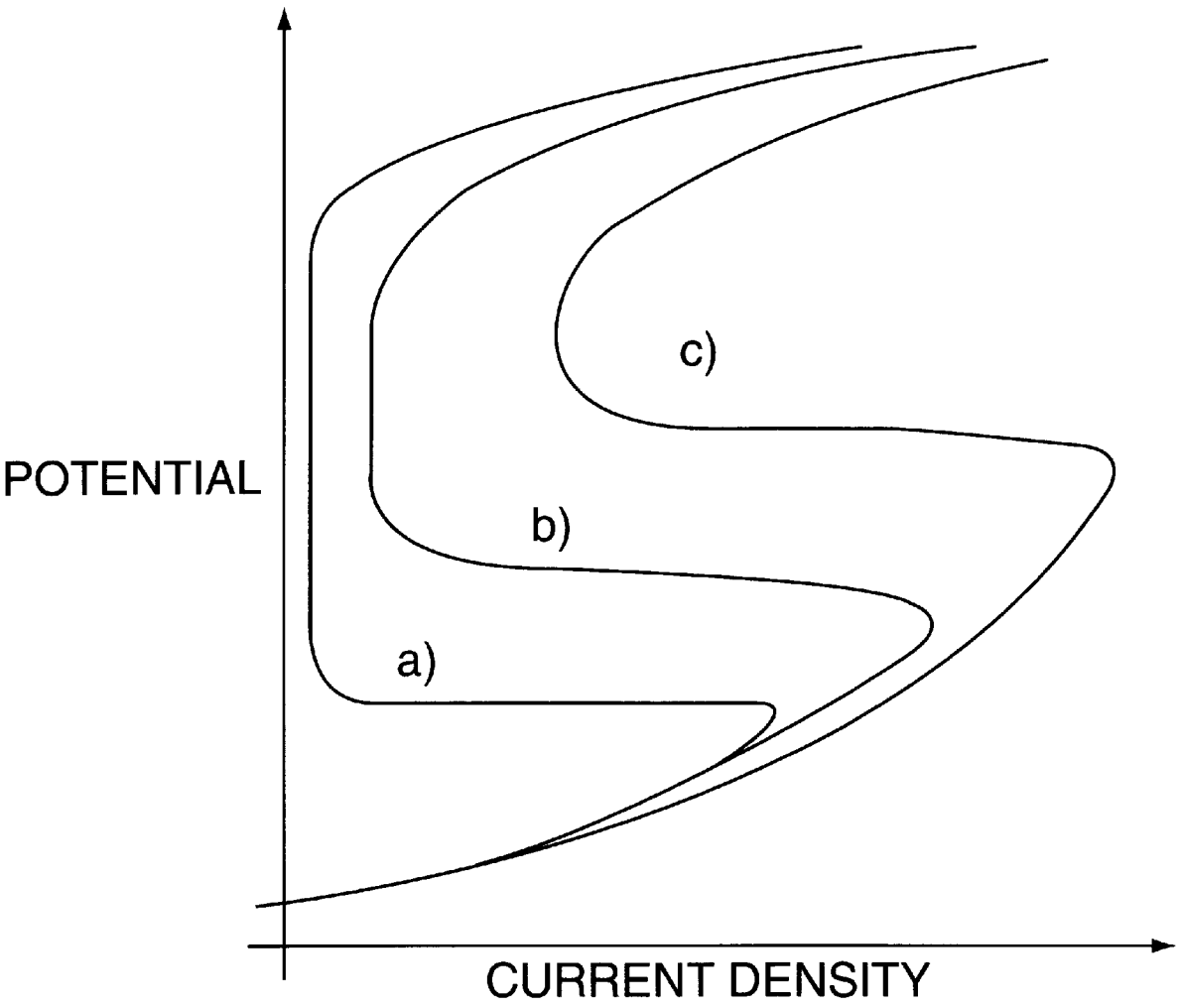

Legend of FIG. 2

Chromium content influence on polarization curve: current density (abscissa) versus the critical passivation potential (ordinate).

a) sufficient Cr b) less than sufficient Cr c) completely insufficient Cr

Figure 3:
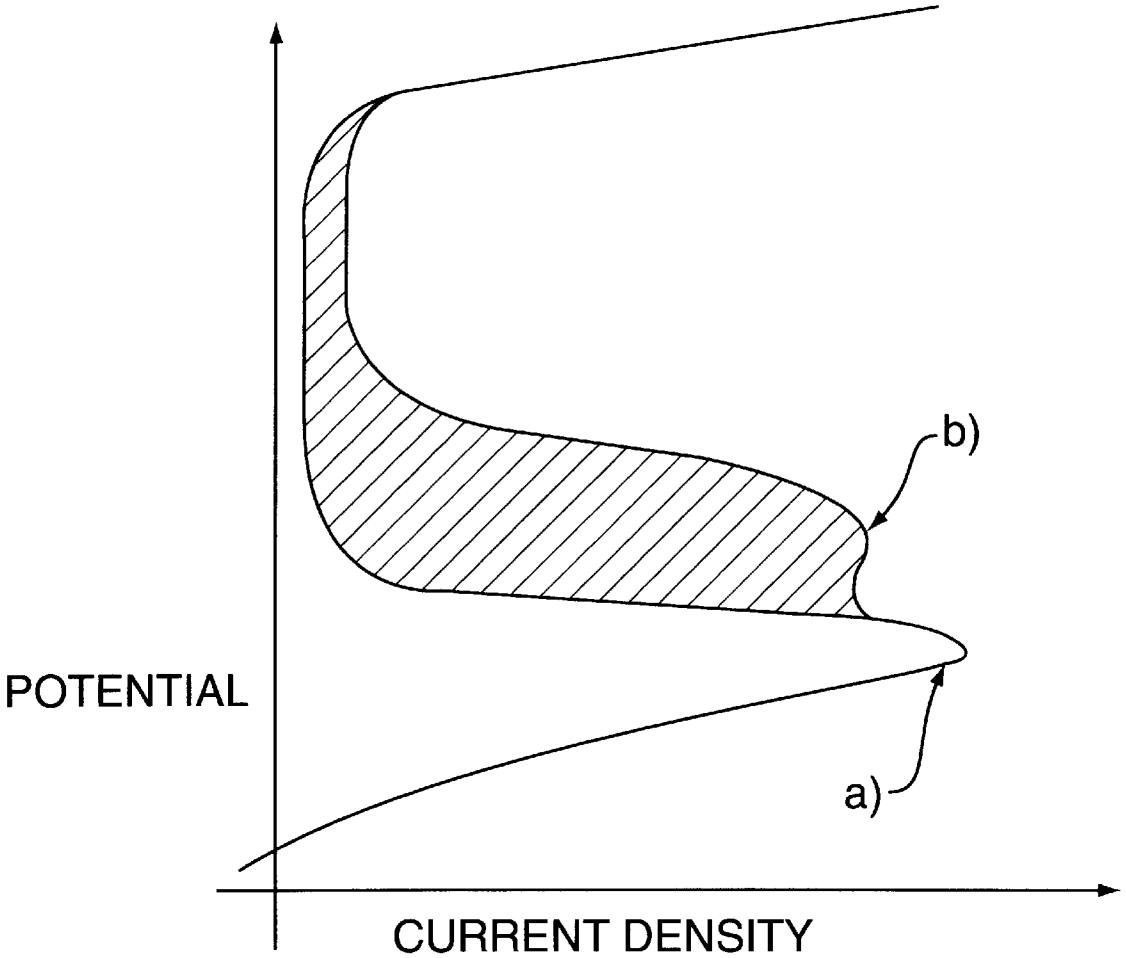

Legend of FIG. 3

Figure 1:
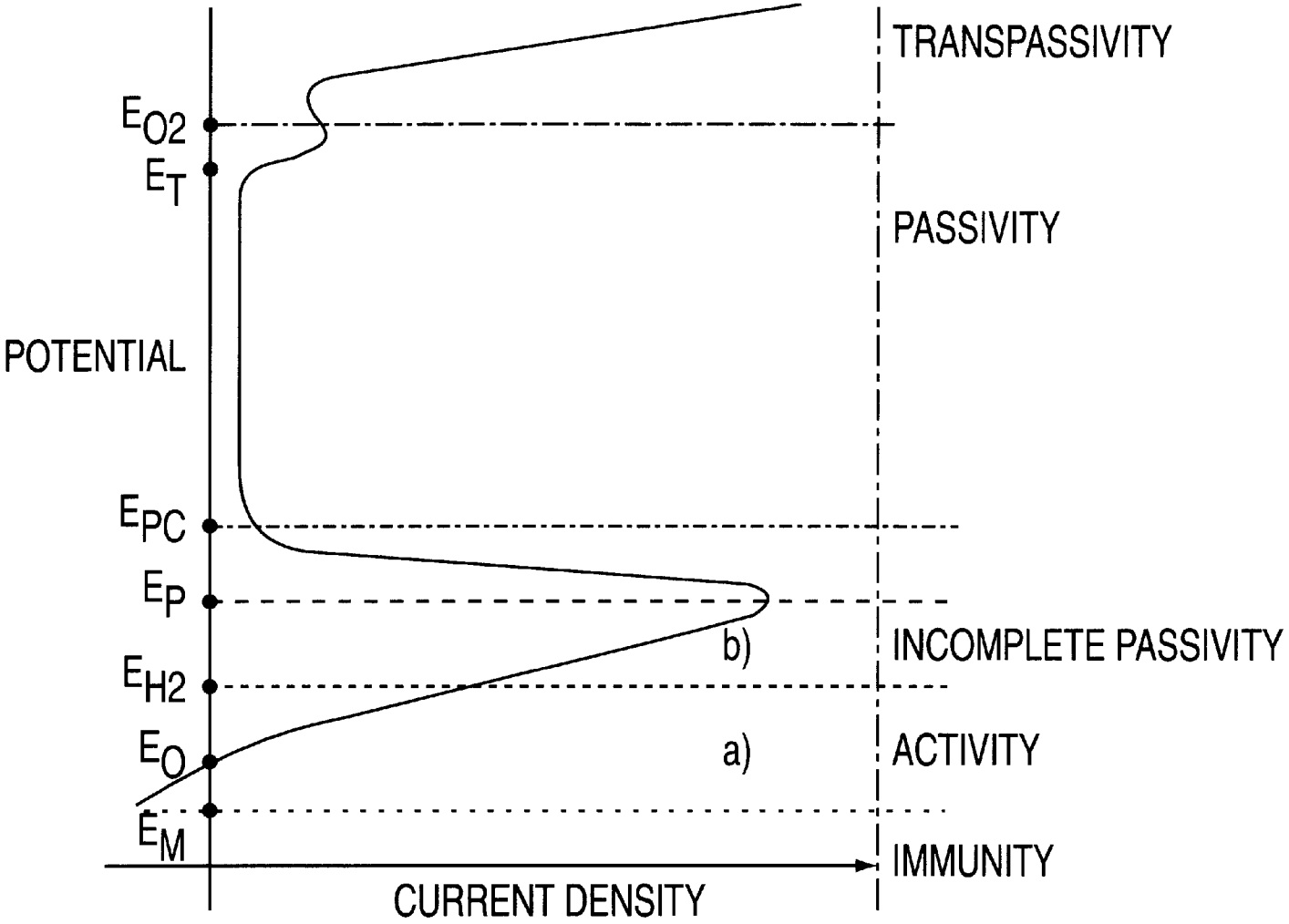

Polarization curve of oxidized Cr steel a) basic alloy peak b) dechromized alloy peak The typical curve of FIG. 1 applies, however, to steel of uniform composition and, mainly, with a chromium content sufficient to bring about passivability (Cr>12%). A lower chromium content modifies the polarization curve as shown by FIG. 2, namely it reduces the passivity field, while increasing the passivity current density and raising the critical passivation potential.

Since, under the scale formed by the hot-rolling or annealing oxide layer, a stainless steel type, such as the one which the invention pickling method refers to, always exhibits a thinner or thicker layer of dechromized alloy, i.e. poorer in chromium than its basic composition, the steel polarization curve always shows the trend indicated in FIG. 3, where the dechromized alloy peak is more or less clearly evident.

To make sure that descaling proper and a thorough removal of the dechromized alloy take place during pickling, with the restoration of max. surface passivability, the bath has to be placed under potentiostatic control conditions. This means that the operating redox potential has to be adjusted so that during the very pickling step it may remain in the range where the dechromized alloy anodic dissolution rate is the highest when compared with that of the basic alloy (hatched area, FIG. 3). It is possible to pre-set the said range as a function of the steel type, while guaranteeing basic metallic material passivation, after dechromized alloy removal.

During pickling, as the bivalent iron ion concentration in the bath rises, the bath redox potential tends to lower, but the addition of hydrogen peroxide and air restores said potential to optimal values, normally higher than 300 mV, in particular exceeding 350 mV. In the applied processes the value of 800 mV is never exceeded.

In case of any particular upstream steel treatment and if a subsequent passivation stage in a separate bath is envisaged, the pickling bath potential may be kept at lower values, anyway not below 250 mV.

A constant potential control, therefore, secures not only good steel pickling, but also the formation of a passivity film on steel. Commercial-scale tests have, in fact, demonstrated the possibility of obtaining polished, bright, and perfectly even surfaces, free from any corrosion phenomenon due, for instance, to pitting, material burning or an excessive pickling action. During pickling bath operation or in case of accidental shutdowns, it is sufficient to guarantee a minimum air blowing to keep the redox potential at optimal values, which makes it possible to leave steel immersed in the solution even for hours with no risk of chemical attack.

Additive content in the bath: when preparing the pickling bath according to the present invention, the normal additives used—in a total amount of approx. 1 g/l bath—are non-ionic surfactants acting as wetting agents, emulsifiers, polishing agents, and acid attack inhibitors. Thanks to a synergic action, these additives improve pickling by favouring it. Particularly advantageous additives are perfluorinated anionic surfactants as well as non-ionic surfactants belonging to the polyethoxylated alkanol derivatives class containing 10 or more C atoms.

An efficient inhibitor guarantees basic metal protection, reduces losses drastically, and results highly effective mainly in the case of batch processes requiring long pickling time (rods, pipes, bars). Table 1 below reports—by way of example—the results of comparative tests conducted to evaluate the weight loss brought about by the traditional process based on the use of $HNO_3$ and HF vs. the invention method.

TABLE 1

Comparative tests conducted to evaluate the weight loss brought about by the traditional process vs. the invention method.

| Test | | Weight Loss at 50° C., g/m2 | |
|---|---|---|---|
| Material (oxide-free) | Treatment time | 53% $HNO_3$ = 20% 40% HF = 10% | Invention Method (*) |
| AISI 316 rod | 60' | 22.5 | 3.6 |
| | 120' | 29.1 | 6.3 |
| AISI 304 rod | 60' | 28.0 | 6.5 |
| AISI 430 rod | 90' | 286.6 | 110.9 |
| AISI 316 1st sheet | 90' | 462.5 | 89.9 |
| AISI 316 2nd sheet | 60' | 162.7 | 55.7 |
| | 120' | 267.5 | 102.2 |
| AISI 304 sheet | 60' | 83.2 | 32.5 |
| | 120' | 137.0 | 68.5 |

*) Bath prepared as follows: $H_2SO_4$ 150 g/l; HF 50 g/l; $Fe^{3+}$ 15 g/l; Potential: 700 mV (initial); Stabilized $H_2O_2$ (130 vol.) 5 g/l; Addivites 1 g/l.

The additives present in the bath, particularly acid attack inhibitors, do not inhibit the attack against oxides caused by heat treatment, hence they do not absolutely limit pickling kinetics, as shown e.g. by the results of tests conducted on AISI 304 shot-peened sheet steel, indicated in Table 2.

TABLE 2

Tests for the evaluation of the inhibiting effect of acid attack inhibitors

| | Tests Conditions |
|---|---|
| Test A) | T° C. = 50° C.; treatment time = 3'; inhibitor (1) quantity: 0.5 g/l |
| Test B) | as per A), but in the absence of wetting agents and inhibitors. |

Results obtained

AISI 304 affected by oxides due to annealing and, therefore, by oxides attack:

Test A)=26.0 g/m2

Test B)=25.5 g/m2

AISI 304 with minimum traces of oxides due to annealing, therefore affected by attack of the bare metal:

Test A)=4.0 g/m2

Test B)=6.0 g/m2

(1) non-ionic surfactant belonging to the ethoxylated fat alcohols class.

Advantages of the Process

Absence of mud: the invention process minimizes or even prevents the formation of mud and sludge, with a consequent clear further saving.

Such an advantage is also due to an appropriate HF concentration during the process cycle, as well as to a control of the concentration of ferrous ions, readily and suitably oxidized to ferric ions.

Differently from the mud and sludge produced by traditional baths using nitric and hydrofluoric acids, the mud and sludge produced to a greatly smaller extent by the invention process bath are a greenish slush, friable and incoherent in the dry state, with no tendency to packing and lumping into large crystals, consequently easy to remove.

Automatic control possibility: the invention process can always be kept under control by automatic means, which— through analytical determinations (free and total acidity, free fluoride ion content, iron ion content, redox potential)—continuously meter the amounts of pickling materials and of stabilized hydrogen peroxide necessary to secure correct operating parameters.

The use of said means offers the following advantages: safety and environment: more timely and quicker process parameter adjustment, no risk of pollution, no risk of loss or test sample transfer, smaller amount of products to be eliminated;

steady pickling quality thanks to idling absence, close control, and sampling frequency;

decrease in costs due to out of standard material reduction and no need for laboratory tests.

Process versatility: the invention process suits any existing commercial plant working stainless steel as the required adjustments are quite modest. Furthermore, it is appropriate for the treatment of manufactures and semimanufactured products of any type whatever, from wire to rod, from belts to sheets and pipes, thanks to operating parameters (temperature, times, concentrations) being changeable without detriment of results. A typical example of such a versatility is represented by the continuous application of the invention process to steel rolling units: by merely changing the working potential, the process can, in fact, be used both during the sole pickling stage (in the case of hot-rolled steel), when only descaling and dechromized surface layer removal are required, and during the stages when steel is to be given final passivation too (in the case of cold-rolled steel). The following examples are reported for the sole purpose of illustrating the possible applications of the invention process.

Example 1—Commercial Plant for Rod Production

More than 12,000 t steel in the form of austenitic stainless steel rods and profiles (AISI 303, AISI 304, AISI 416, AISI 420) was treated in an over 1000 t/month plant.

Austenitic steel was treated in the sole rolled form, while martensitic steel and ferritic steel were treated also in the semimachined or raw sandblasted form.

Pickling by the invention process was carried out in six Moplen-lined vessels, each having a capacity of 8–9 $m^3$.

Pickling conditions for austenitic steel were as per Table 3; those for martensitic steel and ferritic steel were as per Table 4. In both cases, treatment times were a function of the quantity and quality of the removable oxides due to heat treatment, at the outlet of the annealing furnace.

When leaving the pickling bath, steel was subjected to thorough washing with water under pressure.

TABLE 3

Pickling of Austenitic Steel (Series 300)

| | |
|---|---|
| Temperature | 30–35° C. |
| Treatment time | AISI 303 = 60'–120'<br>AISI 304 = 40'–50'<br>AISI 316 = 40'–50' |
| Bath preparation | 150 g/l $H_2SO_4$<br>50 g/l HF<br>15 g/l $Fe^{3+}$ |

air = continuous blowing

TABLE 4

Pickling of Martensitic Steel and Ferritic Steel (Series 400)

| | |
|---|---|
| Temperature | 30–35° C. |
| Semimachined steel | pickling in a bath kept with a controlled free acidity decidedly lower than required by Series 300.<br>Treatment time: 30'–60'. |
| Raw sandlbasted steel | pickling in two steps:<br>A) sulphuric acid bath, for superficial black fine dust removal.<br>Treatment time: 15'–20'.<br>B) pickling bath as in the case of Series 300.<br>Treatment time: 3'–10'. |

130 vol. hydrogen peroxide was used.

Interox S 333 C made by Interox was employed as hydrogen peroxide stabilizer.

Additives consisted of non-ionic surfactants as well as acid attack inhibitors of known types for pickling baths (fluorinated complexes and ethoxylated alcohols). The redox potential initially measured was approx. 700 mV.

Bath feeding consisted in the continuous addition of stabilized hydrogen peroxide in the quantity of 1 g/l per pickling hour plus, from time to time, $H_2SO_4$, HF and the abovementioned additives, depending on the results of analytical tests. The continuous air blowing rate was approx. 30 $m^3$/h into each vessel.

Pickling kinetics resulted to be comparable with, sometimes even higher than, those secured by the traditional process based on the use of nitric and hydrofluoric acids, formerly used in the plant.

The redox potential was kept steadily over 300 mV (preferably between 350 and 450 mV), which resulted in an excellent surface finish of the treated steel.

The life of each vessel's bath—prior to bath partial reconditioning—would grow, on an average, by 50 to 70% because the quantity of treated material per vessel would increase from 150 to 250 tons, with a consequent rise in productivity exceeding 60%.

Total iron content, at the time of bath replacement, would be approx. 100 g/l, $Fe^{3+}$ and $Fe^{2+}$ accounting respectively for 60 g/l and 40 g/l.

In no case the materials showed superficial corrosive attack or burning phenomena.

Precipitate formation was absolutely negligible and no ferrous sulphate or fluorinated complex crystallization occurred. $H_2O_2$ (130 vol.) consumption resulted to be 7.2 kg/t treated material.

Example 2—Commercial Plants for Continuous Sheet Production

Continuous treatment has been carried for four months in commercial plants producing continuous sheets.

Example 2.1

In a plant, pickling concerns two hot-rolling lines handling austenitic, martensitic, and ferritic stainless steel.

Pickling process conditions are, therefore, a function of the type of steel to be treated and of its physical state, namely of whether steel has undergone mechanical descaling. Moreover, since the lines are meant for hot-rolling, the primary object of pickling is descaling and dechromized alloy removal, rather than final steel passivation.

Thus, pickling process conditions are as per the following tables:

TABLE a

| Austenitic steel, series 300 - shot-peened | 1st vessel | 2nd vessel |
|---|---|---|
| Temperature, ° C. | ≦55 | ≦55 |
| $H_2SO_4$, g/l | 80–100 | 80–100 |
| $Fe^{3+}$, g/l | 30–50 | 30–50 |
| Free $F^-$, g/l | 25–35 | 25–35 |
| E redox, mV | 300–320 | 300–320 |

TABLE b

| Austenitic steel, series 300 - non-shot-peened | 1st vessel | 2nd vessel |
|---|---|---|
| Temperature, ° C. | 70–75 | 70–75 |
| $H_2SO_4$, g/l | 80–100 | 80–100 |
| $Fe^{3+}$, g/l | 40–80 | 40–80 |
| Free $F^-$, g/l | >35 | >35 |
| E redox, mV | ≧460 | ≧460 |

TABLE c

| Ferritic or martensitic steel, series 400 - shot-peened | Austenitic steel, series 300 - non-shot-peened 1st vessel | 2nd vessel |
|---|---|---|
| Temperature, ° C. | 40–45 | 35–50 |
| $H_2SO_4$, g/l | 30–50* | 60–100 |
| $Fe^{3+}$, g/l | 30–50 | 15–40 |
| Free $F^-$, g/l | 15–20** | 8–25 |
| E redox, mV | 300–360 | ≧580 |

*AISI 409, 15–20
**AISI409, 8–12

There are two 25 $m^3$ pickling vessels and pickling time ranges, on an average, from 60" to 90" per vessel. Air is forced continuously into the two vessels, at a rate of 50 $m^3/m^3/h$, along with a continuous feeding of hydrogen peroxide stabilized with Interox S 333 C. Acid formulations are fed continuously with $H_2SO_4$, HF and the other various additives referred to in Example 1.

The amount of steel already treated by the invention process exceeds 350,000 tons, the material to be recycled being below 1% of the total treated material. $H_2O_2$ (130 vol.) consumption is 2.3 kg/t treated steel.

Example 2.2

In a second plant, this time meant for cold-rolling, over 100,000 t continuous sheets of steel series 300 and series 400 has already been treated as follows:

1st vessel: electrolytic pickling with $H_2SO_4$ for 1' at a temperature from 60° C. to 70° C.;

2nd vessel: 1' treatment time, at a temperature from 55° C. to 60° C., with the following initial bath:

150 g/l $H_2SO_4$ 48 g/l HF 15 g/l $Fe^{3+}$ 5 g/l $H_2O_2$ (130 vol.)

2 g/l $H_2O_2$ stabilizer (Interox S 333 C)

1 g/l various additives (of the type already indicated)

3rd vessel: 1' treatment time, at a temperature from 55° C. to 60° C., bath composition as for 2nd vessel.

The working capacity of the 2nd and 3rd vessels is 17 $m^3$ each. During treatment, air is forced continuously into the 2nd and 3rd vessels, at a rate of 40 $m^3/m^3/h$, along with a continuous feeding of $H_2O_2$ (stabilized as indicated above) and of the other ingredients ($H_2SO_4$ and HF), so as to keep the following parameters constant:

TABLE a'

| Austenitic steel, series 300 - shot-peened | 2nd vessel | 3rd vessel |
|---|---|---|
| Temperature, ° C. | 60–65 | 60–65 |
| $H_2SO_4$, g/l | 100–150 | 100–150 |
| $Fe^{3+}$, g/l | 20–60 | 15–50 |
| Free $F^-$, g/l | 20–30 | 20–30 |
| E redox, mV | ≧280 | ≧350 |

TABLE b'

| Austenitic steel, series 300 - non-shot-peened | 2nd vessel | 3rd vessel |
|---|---|---|
| Temperature, ° C. | 60–65 | 55–60 |
| $H_2SO_4$, g/l | 100–150 | 100–150 |
| $Fe^{3+}$, g/l | 20–60 | 15–50 |
| Free $F^-$, g/l | 30–40 | 20–30 |
| E redox, mV | ≧280 | ≧450 |

TABLE c'

| Ferritic or martensitic steel, series 400 - shot-peened | 2nd vessel | 3rd vessel |
|---|---|---|
| Temperature, ° C. | 50–60 | 35–50 |
| $H_2SO_4$, g/l | 100–150 | 60–100 |
| $Fe^{3+}$, g/l | 30–80 | ≧15 |
| Free $F^-$, g/l | 20–30 | 8–15 |
| E redox, mV | 250–280 | ≧580 |

The superficial aspect of sheets at the end of the pickling process cycle has always resulted to be polished and bright, even better than secured by the traditional process (HF+$HNO_3$).

In this case too, no overpickling or superficial corrosion phenomenon has been recorded.

$H_2O_2$ (130 vol.) consumption is 2.2 kg/t treated steel.

Example 3—Commercial Plants for Pipe Production

Pipes of austenitic steel series 300 manufactured on a commercial scale are being treated from September 1991 under pickling bath conditions similar to those described in Example 1.

Temperature is 45° C. to 50° C. and the treatment time varies, according to the type of material, from 30' to 60'.

The pickling cycle behaviour and the results obtained, validated by as much as 20,000 t steel being already treated are similar to those described in Example 1 as far as concerns consumption, redox potential behaviour, final steel superficial aspect, attack kinetics, and finally, the absence of whatever phenomenon of corrosive attack.

CONCLUSIONS about commercial-scale tests.

From the foregoing description and examples it appears evident that the new stainless steel pickling and passivation process, characterized by a bath having a specific composition, by bath control—mainly redox potential control—throughout the pickling cycle, and by continuous air blowing into, represents an optimal solution—from the viewpoint of technical results and process economics (mainly connected with low $H_2O_2$ consumption)—of the pollution problem brought about by traditional processes using nitric acid.

What is claimed is:

1. Pickling process for chromium containing stainless steel comprising placing said chromium containing stainless steel in a pickling bath kept at a temperature ranging from 30° C. to 70° C. and wherein said pickling bath prior to placing said chromium containing stainless steel in said pickling bath comprises the following components:

a) $H_2SO_4$ in an amount of at least 150 g/l;

b) $Fe^{+3}$ ions in an amount of at least 15 g/l;

c) HF in an amount of at least 40 g/l;

d) stabilized $H_2O_2$, which develops 130 liters of $O_2$/l, in an amount between 1 and 20 g/l;

e) non-ionic surfactants or anionic fluorinated surfactants in total amount of about 1 g/l; and feeding to the bath during the process:

a continuous air flow of at least 3 $m^3$/h per $m^3$ bath, through a diffuser distributing the flow in the liquid bath;

stabilized $H_2O_2$ in a quantity adjusted to keep a Redox potential of the bath of at least 250 mV;

additional quantities of ingredients a), c) and e), if necessary, based on analysis of the bath during the process, in order to keep optimal concentrations of the above components and a bath pH up to 1.5.

2. Process according to claim 1, wherein ferric sulfate is introduced into the initial bath as a source of $Fe^{3+}$ ions.

3. Process according to claim 1, wherein the non-ionic surfactant is a polyethoxylated alkanol derivative containing at least 10 C atoms.

4. Process according to claim 1, wherein a preliminary partial removal of oxides from the surface of the chromium containing stainless steel to be pickled is carried out.

5. Process according to claim 1, wherein the pickling bath is adjusted to a Redox potential of at least 300 mV.

6. Process according to claim 1, wherein through the addition of components a), c), and d) during the process, the concentrations in the bath are kept between the following limits:

$H_2SO_4$ between 30 and 150 g/l;

HF in an amount corresponding to an F— content between 8 and 50 g/l; and $Fe^{3+}$ ions between 15 and 80 g/l.

7. Process according to claim 1, wherein through the addition of components a), c), and d) during the process, the concentrations in the bath are kept between the following limits:

$H_2SO_4$ between 80 and 100 g/l;

HF in an amount corresponding to an F— content between 25 and 35 g/l; and $Fe^{3+}$ ions between 30 and 50 g/l.

8. Process according to claim 1, wherein through the addition of the components a), c) and d) during the process, the concentrations in the bath are kept between the following limits:

$H_2SO_4$ between 100 and 150 g/l;

HF in an amount corresponding to an F— content between 20 and 30 g/l; and $Fe^{3+}$ ions between 20 and 60 g/l.

9. Process according to claim 1, wherein through the addition of the components a), c) and d) during the process, the concentrations in the bath are kept between the following limits:

$H_2SO_4$ between 60 and 100 g/l;

HF in an amount corresponding to an F— content between 8 and 25 g/l; and $Fe^{3+}$ ions between 15 and 40 g/l.

10. Process according to claim 1, wherein through the addition of the components a), c) and d) during the process, the concentrations in the bath are kept between the following limits:

$H_2SO_4$ between 30 and 50 g/l;

HF in amount corresponding to an F— content between 15 and 20 g/l; and $Fe^{3+}$ ions between 30 and 50 g/l.

11. Process according to claim 1, wherein through the addition of the components a), c) and d) during the process, the concentrations in the bath are kept between the following limits:

$H_2SO_4$ between 80 and 100 g/l;

HF in an amount corresponding to an F— content of greater than 35 g/l; and $Fe^{3+}$ ions between 40 and 80 g/l.

12. Process according to claim 1 wherein the surfactant is an anionic fluorinated surfactant.

* * * * *